United States Patent [19]

Price

[11] 4,133,527

[45] Jan. 9, 1979

[54] BOWLING BALLS

[75] Inventor: Floyd L. Price, Costa Mesa, Calif.

[73] Assignee: AMF Incorporated, White Plains, N.Y.

[21] Appl. No.: 761,100

[22] Filed: Jan. 21, 1977

[51] Int. Cl.[2] ..... A63B 37/14; A63B 37/12

[52] U.S. Cl. ..... 273/63 D; 273/58 J; 273/58 K

[58] Field of Search ..... 273/63 R, 63 G, 65 EG, 273/63 E, 63 D, 61 C, 58 J, 58 K, 128 A

[56] References Cited

U.S. PATENT DOCUMENTS

| | | | |
|---|---|---|---|
| 2,291,738 | 8/1942 | Luth et al. | 273/63 E |
| 3,270,108 | 8/1966 | Randolph | 273/63 G |
| 3,740,354 | 6/1973 | Dearmont | 273/63 R |

FOREIGN PATENT DOCUMENTS

| | | | |
|---|---|---|---|
| 6407 of | 1914 | United Kingdom | 273/65 EG |

*Primary Examiner*—George J. Marlo

*Attorney, Agent, or Firm*—George W. Price; Walt Lewis

[57] ABSTRACT

Soft rubber buffing dust is dispersed throughout the hard rubber cover of a bowling ball. When polished, cavities are formed in the cover, resulting in increased traction or grip between the bowling ball and bowling lane surface.

1 Claim, 1 Drawing Figure

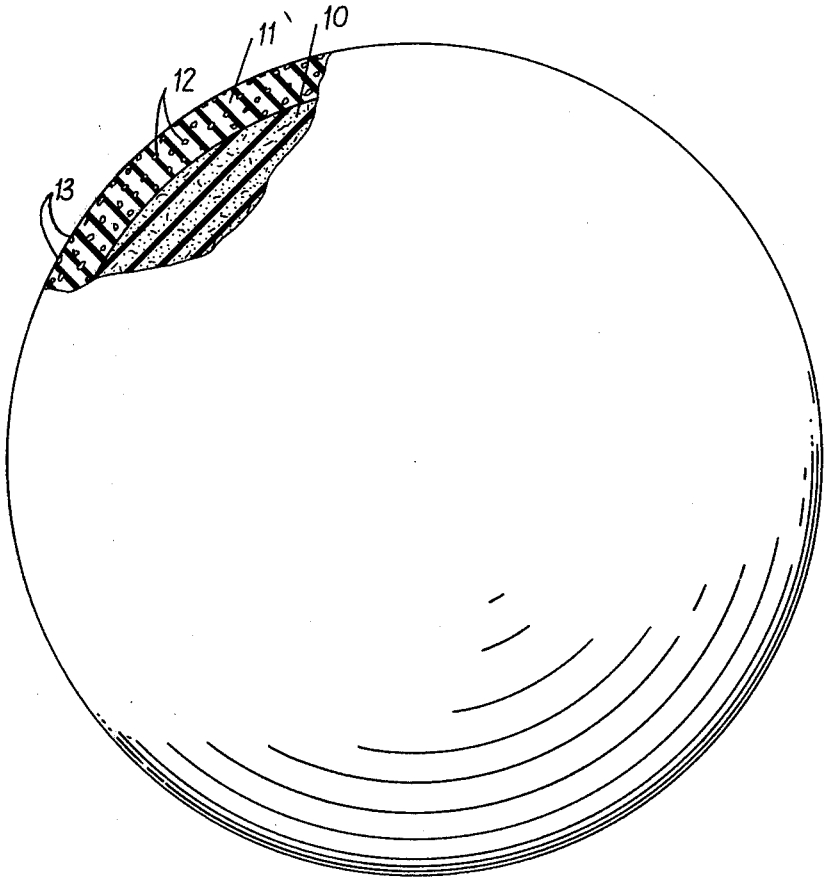
10
11
12
13

BOWLING BALLS

This invention relates to an improvement in bowling balls, and more particularly, to a hard rubber bowling ball having increased traction with the bowling lane surface.

In the game of bowling, the balls and lanes have a high gloss. There are times when the player will want the ball to curve or hook in its track along the lane. In the prior art, due to the high gloss on the balls and the lanes, this is a maneuver that requires considerable practice and skill. In the invention, I provide means in the ball surface during ball manufacture which will increase traction between the ball and lane which will make it easier for the player to curve or hook the ball.

My invention is applicable to hard rubber bowling balls and will now be described in connection with the accompanying sheet of drawing taken therewith. In the invention minute cavities are formed in the ball surface. These cavities are small, but apparent to the naked eye, and more so with a common magnifying glass. The cavities are distributed throughout the entire surface of the ball cover, and have the effect of increasing the grip of the ball on the lane surface as compared to prior art high gloss balls. The appearance of the ball after polishing and buffing is not a smooth high gloss finish. Rather, it has the appearance of being somewhat rough and semi-glossy.

Briefly, heretofore in the manufacture of hard rubber bowling balls, first a mix of uncured rubber, sulfur and a filler such as saw dust is cured in a pair of mold halves in an oven to provide a hard rubber core 10. The core is then roughed, and again placed in a pair of mold halves between two slabs of uncured rubber and sulfur in an oven to form a hard rubber cover 11 on the core. No fillers are added to the cover so that after the cover is ground and coarse to fine, polished and buffed, it will have a hard smooth finish which is glossy. The core is approximately 8" in diameter and the cover ¼" thick.

In the just described method, the cover has the following composition by parts weight:

| | |
|---|---|
| Rubber | 100 |
| Sulfur | 40 |
| Carbon Black | 10 |
| Accelerator | 2 |

This is typical for a black hard rubber bowling ball, as will be readily understood by those skilled in the art. In my invention the cover composition is modified by adding about 10 parts weight sulfur and 260 parts weight soft rubber buffing dust. Soft rubber buffing dust has about only a small amount of sulfur, about 3%, and can comprise ground scrap from tire treads or the like.

This buffing dust and the additional amount of sulfur is mixed with the uncured rubber and sulfur of the previously mentioned uncured two slabs of rubber and sulfur. So, when they are cured into a hard cover on the ball core, the cover has minute particles of rubber 12 which are somewhat softer than the cover itself. Therefore, when the cover is ground and coarse to fine polished as before, the softer rubber particles are dislodged or flaked out of the outer ball surface, to thereby leave minute cavities 13 on the finished ball surface which is what gives it its somewhat rough or semi-gloss appearance.

The buffing dust selected is that which will pass a 35 mesh screen. A larger particle size for the buffing dust is not desired since this makes the ball cover surface cavities needlessly large for the purpose intended. In addition, larger cavities make the ball unsatisfactory from a cosmetic point of view in that it is too rough and dull looking in appearance to be attractive to the ball purchaser, and could even be mistaken for a used alley ball.

The previously mentioned high gloss hard rubber ball cover had an 85–95 "D" Shore or Rex hardness. In the invention the cover is 75–85 hardness. This decreased hardness also contributes to increased traction with the lane surface. It appears that the reduced hardness in the cover from 85–95 to 75–85 is not due to the presence of the soft rubber particles per se embedded in the cover, but rather because of absorption of some sulfur by the dust particles from the cover, and especially from those parts of the cover immediately bounding the cavities or the embedded soft rubber particles. The additional sulfur added to the two slabs with the soft rubber dust makes the buffing dust harder, but not quite as hard as the cover, and it appears that the buffing dust acts to extract some sulfur from the cover to make it slightly softer in hardness than heretofore. It will be appreciated that in order to have cavities in the finished ball surface after grinding and polishing, for the buffing dust particles to be removed from those cavities by those operations, they must be unlike or not of the same hardness as the surrounding material. Since they are in fact softer than the surrounding ball cover material, those particles are readily dislodged from their cavities as the ball is ground and polished.

In conclusion, present hard rubber bowling balls are excessively hard and extremely smooth so that the balls have very poor hooking and/or curve holding characteristics on bowling lane surface. A softer and rougher ball surface improves the grip of the ball on the lane thereby increasing the potential for a bowler to achieve higher bowling scores. The addition of soft rubber buffing dust to the ball cover provides a dual function. It cures into the hard rubber cover so as to give minute areas of low hardness which show up as minute pores or voids on the ball surface after grinding and polishing. Secondly, it will help control the surrounding hard rubber cover matrix by scavenging sulfur therefrom, thereby helping to control final ball cover hardness. Therefore, and in view of the foregoing, it will be obvious to those skilled in the art that the specific figures heretofore set forth are not to be taken as limiting but are illustrative of one preferred form of the invention.

I claim:

1. In a hard rubber bowling ball, comprising a hard core and a surrounding hard rubber approximately ¼ inch thick outer cover, the improvement of minute cavities distributed solely throughout said cover, including its outer surface, to give increased traction between the ball and a bowling lane surface, wherein said cavities at said outer surface are empty, and said cavities in the rest of the cover being filled with particles of rubber which are softer in hardness than that of the cover.

* * * * *